United States Patent [19]

Frenette et al.

[11] 4,261,414

[45] Apr. 14, 1981

[54] DIE CASTING MACHINE

[75] Inventors: Remi Frenette, St. Bruno; Maurice Doucet, St. Leonard; Pierre Lamy, Chomedey, all of Canada

[73] Assignee: Techmire Ltee., Quebec, Canada

[21] Appl. No.: 22,931

[22] Filed: Mar. 21, 1979

[51] Int. Cl.[3] ..... B22D 17/04

[52] U.S. Cl. ..... 164/316; 164/318

[58] Field of Search ..... 164/309–311, 164/316–318, 339, 343; 222/593, 596

[56] References Cited

U.S. PATENT DOCUMENTS

| | | | |
|---|---|---|---|
| 1,058,184 | 4/1913 | Kramer | 164/312 X |
| 1,346,077 | 7/1920 | Carter | 164/316 X |
| 1,673,833 | 6/1928 | Lester | 164/311 |
| 1,956,002 | 4/1934 | Bungay | 164/311 |
| 2,004,959 | 6/1935 | Morin et al. | 164/316 X |
| 2,947,045 | 8/1960 | Goldhamer | 164/303 |
| 3,364,981 | 1/1968 | Perrella et al. | 164/339 X |
| 3,540,524 | 11/1970 | Bachelier | 164/303 |
| 3,652,073 | 3/1972 | Lewis | 164/312 X |
| 3,971,432 | 7/1976 | Hardey | 164/343 X |

*Primary Examiner*—Robert D. Baldwin

*Attorney, Agent, or Firm*—Cushman, Darby & Cushman

[57] ABSTRACT

A die casting machine has a frame with a base plate pivotally mounted thereon and supporting a furnace pot. A die assembly is mounted on the front face of the base plate and a double locking toggle arrangement is used to open and close the dies. The gooseneck assembly is mounted for linear movement to actuate the nozzle onto the die parting line.

3 Claims, 6 Drawing Figures

DIE CASTING MACHINE

This invention relates to die casting machines and in particular a machine of the type for producing precision die castings with a compact toggle mechanism providing a clamping force in excess of 20 tons.

The die casting machine according to the present invention provides several important improvements in the art including a nozzle and gooseneck which move on a direct path toward and away from the parting line of the dies as well as a double toggle arrangement for the dies and their carriers to provide an extremely high clamping force for a machine of its size. A novel valve arrangement in the gooseneck provides a rapid and efficient manner in providing molten zinc to the die cavity.

According to one aspect, the present invention relates to a die casting machine having a frame supporting a base plate as well as a pot for melting casting metals such as zinc. A multi-slide die guide is mounted on the front of the base plate and a double locking toggle means is provided for actuating the dies and/or cores in the guide. A gooseneck assembly is mounted on the melting pot and includes pump means for filling a shot chamber in the gooseneck and for making a shot through the gooseneck into the cavity of the dies. A gate member is provided for directing molten metal from the pot into the chamber or from the chamber into the die cavity responsive to movement of the pump. Means are provided for effecting straight, linear movement of the gooseneck and the nozzle toward and away from the parting line of the dies.

The invention is illustrated by way of example in the accompanying drawings in which.

Figure 1:
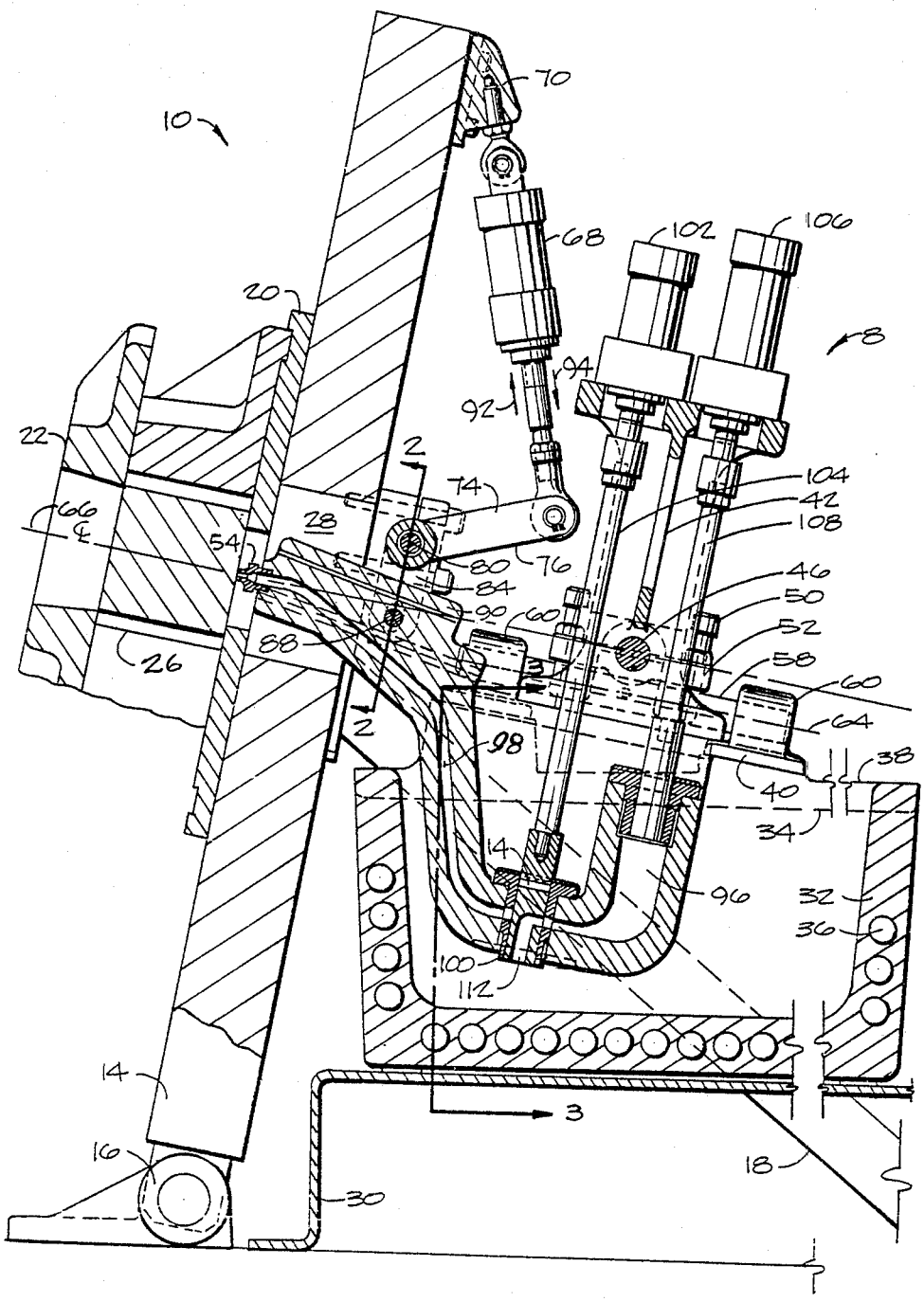
FIG. 1 is a partial cross-section of the die casting machine according to the present invention.

Referring to FIG. 1, the die casting machine illustrated generally at 10 comprises a frame member 12 (shown only partially) supporting a base plate 14 of substantial thickness through a pivotal mounting 16 to the frame 12 adjacent the forward end thereof and by angular struts 18 extending from the rear part of the frame up to a supporting position on the rear of the base plate 14. The latter supports on its front face a multi-slide die guide 20 detachably secured to the plate 14, the die guide including a detachable cover 22 and incorporating a plurality of slide-ways 26 for the die carriers. As seen in FIG. 1, the die guide 20 is concentrically positioned over a large aperture 28 in the base plate 14 to allow communication between the dies and the nozzle of the gooseneck in a manner hereinafter described.

Figure 3:
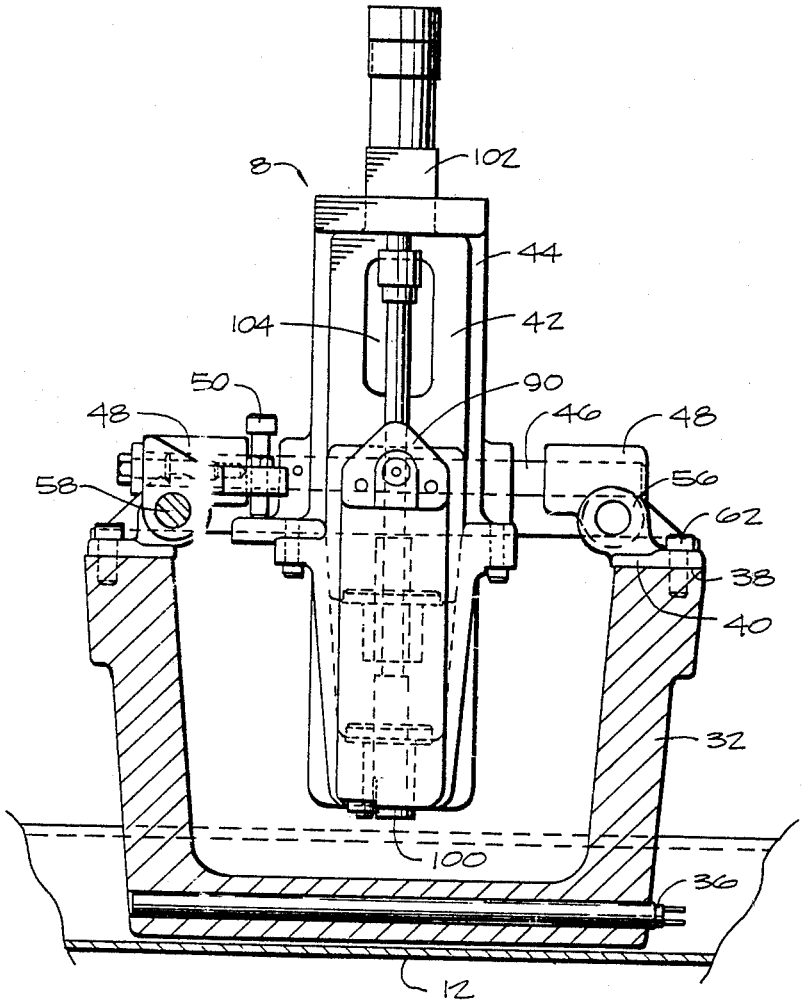
FIG. 3 is a cross-sectional view taken generally along the line 3—3 of FIG. 1.

A frame member 30 supports a furnace pot 32 for melting and containing a casting metal such as zinc, the level of which is indicated by a phantom line 34. The interior of the pot 32 is maintained at a desired temperature by a plurality of electric cartridge heaters 36 positioned throughout the side walls and bottom wall of the pot as indicated in FIGS. 1 and 3. The upper edges 38 of the side walls of the pot 32 are provided with support surfaces 40 for mounting a gooseneck assembly shown generally at 8 in FIGS. 1 and 3. In this regard, the gooseneck assembly 8 has a central web 42 and side members 44 with a shaft 46 running therethrough, the ends of shaft 46 being pivotally mounted in journal bearings 48. Cap screws 50 acting through captive nuts 52 serve to adjust the attitude of the gooseneck 8 with respect to the central shaft 46 for vertical alignment of the nozzle 54 relative to the cavity in the dies.

Figure 2:
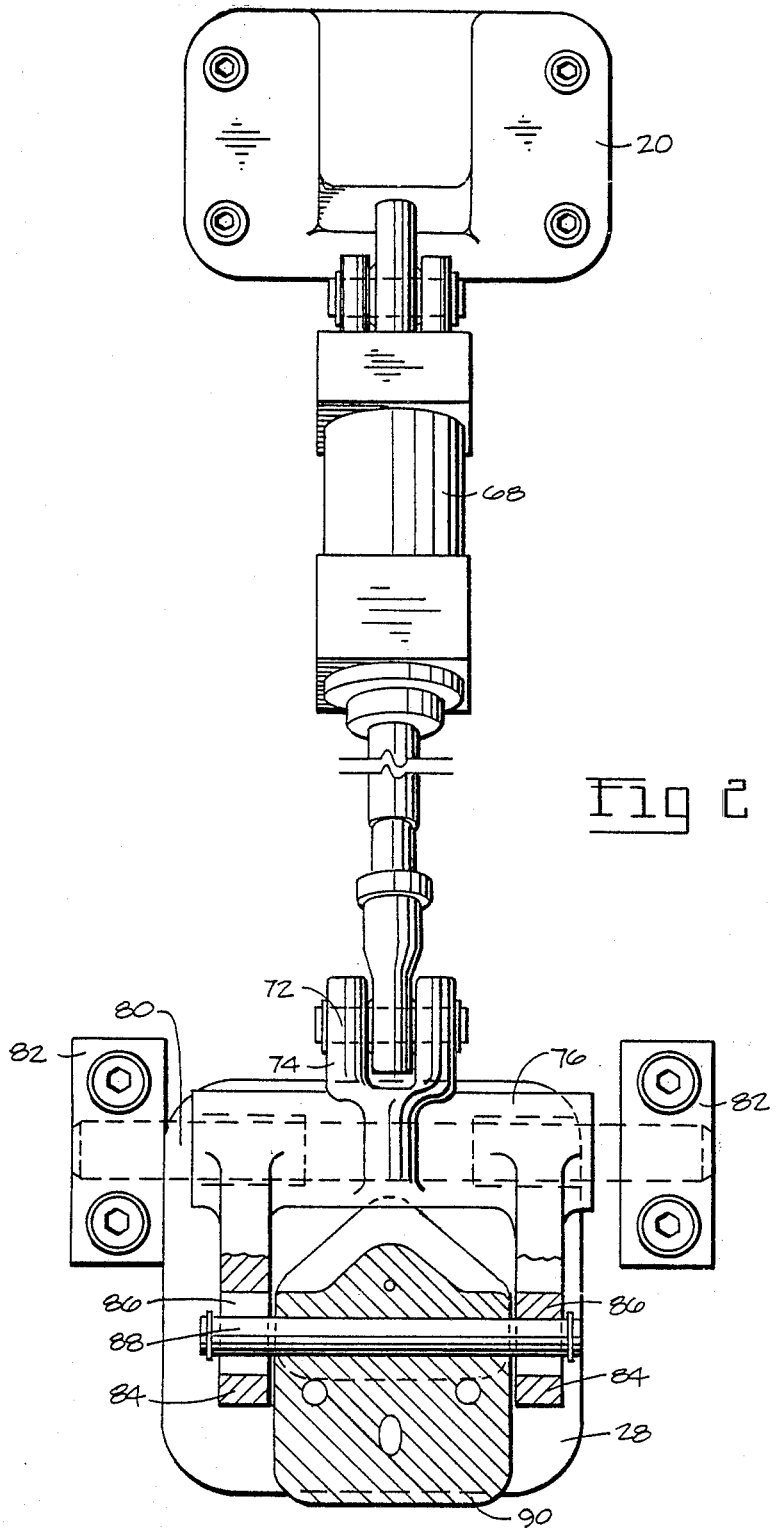
FIG. 2 is a view of the rear portion of the base plate as viewed through the line 2—2 in FIG. 1.

Bearings 48 also include integral bearings 56 for mounting the gooseneck 8 for linear movement along shafts 58 mounted at each of their ends in journal blocks 60 which in turn are secured by cap screws 62 to the upper surfaces 40 of the side walls of the pot 32. It will be appreciated from FIG. 1 that the longitudinal axis 64 of the shafts 58 are parallel to the center line 66 of the nozzle 54 so that movement of the gooseneck 8 along the shafts 58 will move the assembly including the nozzle 54 toward and away from the dies in a straight, linear manner. Means for effecting the movement of the gooseneck is seen in FIGS. 1 and 2 where a linear actuator 68 is pivotally secured to the upper end of the rear surface of the base plate 14 through mounting plate 70 or the like. The other end of the actuator 68 is coupled by way of a roll pin 72 to one arm 74 of a bell crank 76. This member is pivotally mounted by shaft 80 to journal blocks 82 detachably secured to the back of the base plate 14 on either side of the central aperture 28 therein. The bell crank 76 has two other extending arms 84 having elongated apertures 86 therein for receiving a shaft 88 which is mounted transversely in the upper end of the gooseneck proper 90.

It will be appreciated from FIG. 1 that operation of the actuator 68 in the direction of arrow 92 will pivot the bell crank 76 so that by virtue of its connection with the gooseneck 90 through the pin 88, the complete gooseneck assembly 8 will be moved rearwardly along the shafts 58, drawing the nozzle 54 directly back from its FIG. 1 position where it engages the dies at the parting line thereof. Operation of the actuator in the opposite direction, in the direction of arrow 94, pivots the bell crank 76 in the opposite direction to move the complete assembly 8 to the left in FIG. 1 and to bring the nozzle 54 up against the parting line of the dies, the pressure in the actuator 68 maintaining the nozzle in its operative position.

The gooseneck 90 includes a pump chamber 96 communicating with the nozzle 54 by way of a passageway 98 through a gate valve 100. It will be seen from FIG. 1 that gate valve 100 is provided with an actuator 102 and connected thereto by a shaft 104. Also supported by the web 42 of the assembly 8 is a further actuator 106 which is connected by a shaft 108 to piston pump 110 mounted in the top of the pump chamber 96. Gate valve 100 has two apertures therein, the first aperture 112 providing communication between the pump chamber 96 and the interior of the furnace pot 32 and the other aperture 114 providing communication between the chamber 96 and the nozzle 54 through the passageway 98, when the gate valve is moved to its lower position, not shown. In operation, the gate 100 is closed as shown in FIG. 1 opening the aperture or channel 112 to the interior of the pot 32 and the piston pump 110 is drawn upwardly by the actuator 106 to fill the chamber 96.

The gate 100 is lowered by the actuator 102 and shaft 104 so that the aperture 114 is in line with the passageway 98 and a shot is made by the piston pump 110 through the nozzle to fill the cavities in the dies. When the pressure is such that the cavity has been filled, the gate 100 is raised and the excess pressure from the piston pump 110 is exhausted into the pot via the channel 112. When the gate is in its raised position of FIG. 1 the gooseneck passageway 98 is full of molten casting metal, the gate 100 blocking the metal from draining back toward the chamber 96. The pump 110 is then again drawn upwardly to fill the chamber 96, thus completing the cycle.

Figure 4:
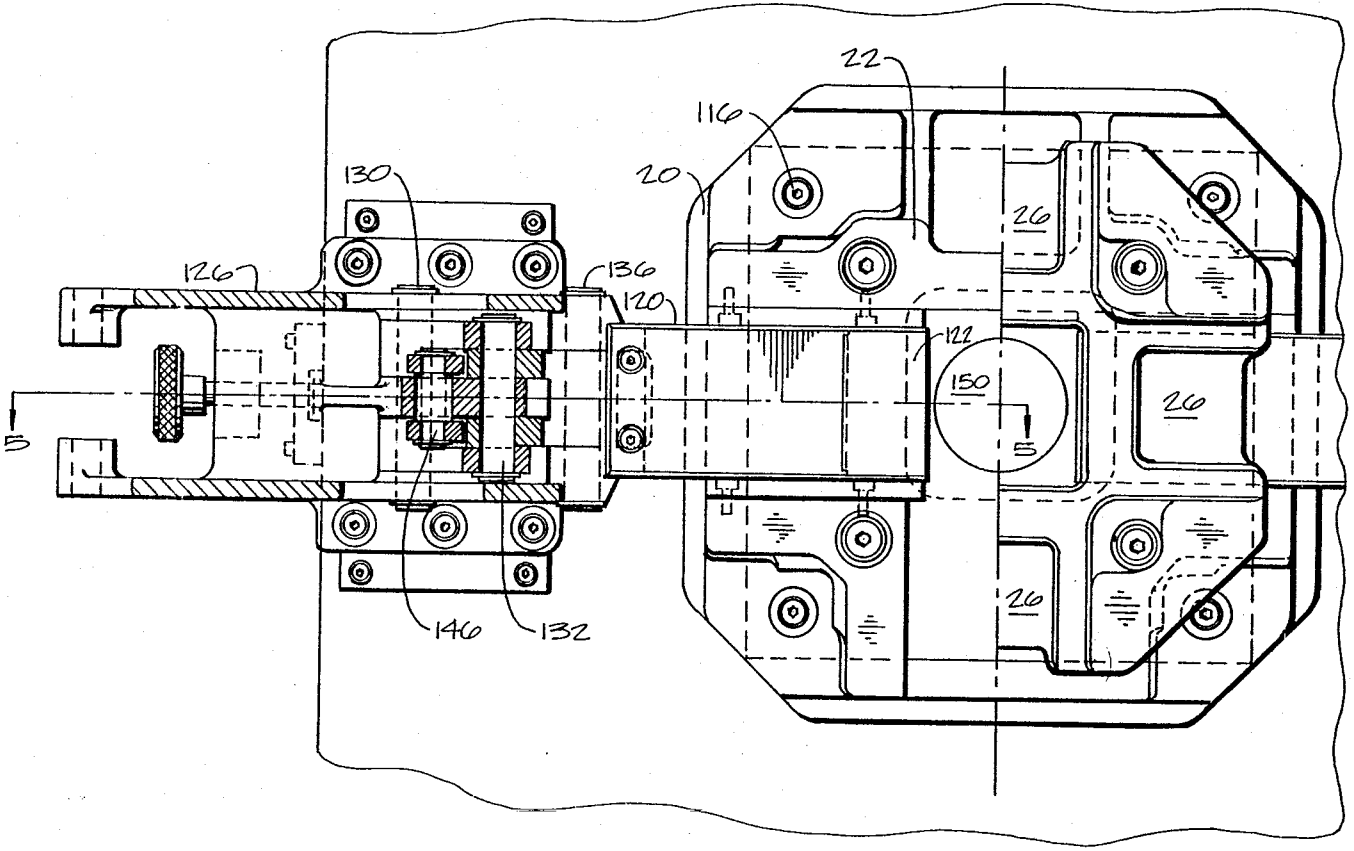
FIG. 4 is a frontal view of a portion of the machine showing the die guide and one of the toggle mechanisms for actuating the dies in the guide, the toggle mechanism as shown in the open position.
Figure 5:
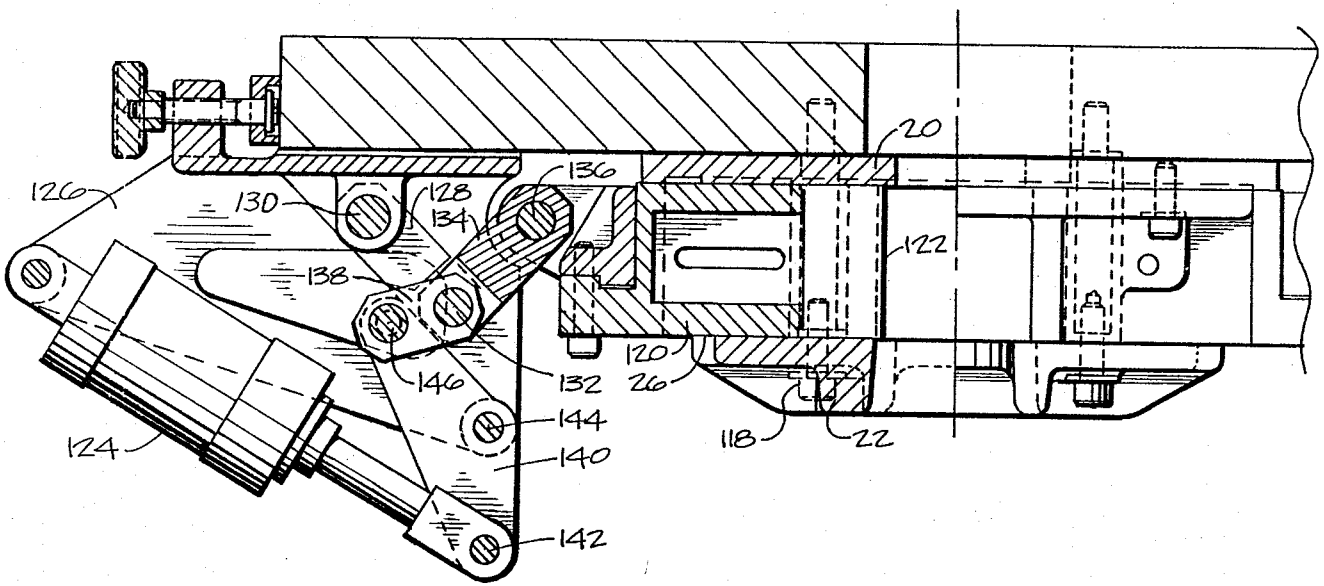
FIG. 5 is a cross-sectional view taken along the line 5—5 in FIG. 4.

Referring to FIG. 4, the die guide 20 is secured to the base plate 14 by bolts 116 and the top 22 is secured to member 20 by cap screws 118. The guide 20 is provided with a plurality of slideways 26 each of which is adapted to receive a carrier 120 for a die member 122 as shown in FIG. 5.

The dies 122 are actuated to open and closed positions by means of an actuator 124 which is supported for operation by a yoke member 126. The latter provides support for the actuator and for the linkage between the operative end of the actuator and the die carrier 120. In FIGS. 4 and 5, the linkages and die carriers are shown in the open position and as shown in FIG. 5, a first link 128 is pivoted by means of a roll pin 130 to the yoke 126 and at its other end, first link 128 is similarly connected by way of a pin 132 to a second link 134, the other end of which is pivotally connected by a pin 136 to the end of the die carrier 120. A third link, 138 interconnects pin 132 with one end of a bell crank 140, the other end thereof being pivotally connected at 142 to the operative end of the actuator 134. The central portion of the bell crank is pivoted through a pin 144 to a wing of the yoke 126.

Figure 6:
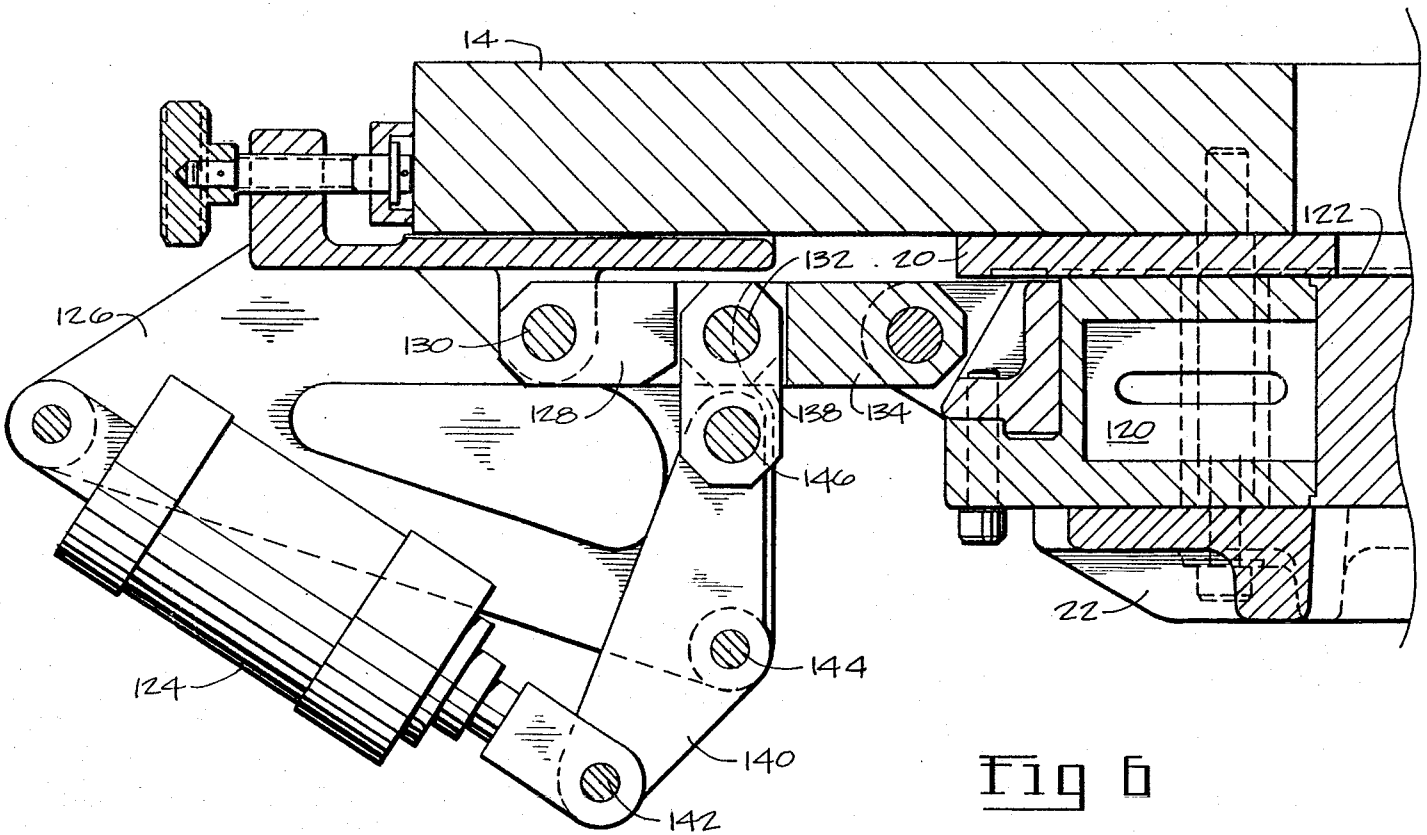
FIG. 6 is a view similar to FIG. 5 but showing the toggles with the die carrier in a closed position.

Referring to FIG. 6, it will be seen that the actuator 124 has been operated to draw its piston end inwardly to swing the bell crank 140 so that the first and second links 128, 134 are brought into linear alignment with one another thereby driving the carrier 120 and its die 122 to the closed position, the third link 138 serving to lock the first and second links in place, the pivot points 142, 132 as well as the pivot 146 lying in alignment with one another and at 90 to the pivot pins connecting the first and second links.

It will be appreciated that the present invention provides a die casting machine with a novel toggle arrangement which gives it double locking provision to the die carrying shanks. The die carrying base plate 20, while illustrated in FIGS. 4, 5 and 6 with a carrier 120 and die 122 thereon can provide three additional slideways 26 as shown in FIG. 4 and a fifth position normal to the plane of operation of the shanks 120 and mounted centrally in the opening 150 as shown in FIG. 4. Accordingly, the machine may provide five slideways at 90° to each other in any combination and any one of these slideways would have the capacity of retracting fine cores before the mold openings or to maintain the ejector mechanism fixed during the opening of the mold sections and to release the molding at any location of the mold opening stroke.

While the present invention has been described in connection with a specific embodiment thereof and then a specific use, it will be appreciated that various modifications thereof will occur to those skilled in the art without departing from the spirit and scope of the invention as set forth in the appended claims.

The terms and expressions which have been employed in this application are used as terms of description and not of limitation and there is no intention in the use of terms and expressions to exclude any equivalents of the features shown and described or portions thereof, but it is recognized that various modifications are possible within the scope of the invention claims.

We claim:

1. A die casting machine comprising in combination, a frame supporting a base plate and a metal melting pot; a die guide mounted on the front of said base plate; double locking toggle means for actuating dies and cores in said guide; a gooseneck assembly, including a passageway, mounted on the melting pot and including pump means for filling a pump chamber in the gooseneck and for making a shot through the gooseneck passageway into the cavity of said dies; a gate member for selectively directing molten metal from the pot into the chamber or from the chamber into the die cavity responsive to movement of the pump; and means for effecting linear movement of said gooseneck and nozzle toward and away from the parting line of said dies; said toggle means comprising a yoke member mounted to said base plate adjacent the end of each die guide and a link assembly for connecting an actuator to the carrier of the die in the die guide; said link assembly comprising first and second links connecting the die carrier to the yoke assembly; a bell crank pivotally mounted on said yoke and having one end pivotally secured to said actuator and its other end similarly secured to the juncture of the first and second link members by way of a third link member.

2. The die casting machine of claim 1 wherein said metal melting pot includes guide means on the sides thereof for positioning said gooseneck assembly, said guide means having longitudinal axis parallel with the centre line of the nozzle whereby movement of the gooseneck assembly on the guide means moves the nozzle linearly into and out of engagement with the parting line of the dies, said guide means including a shaft extending transverse to the gooseneck and secured thereto and a shaft mounted on either side of the pot transverse to the first mentioned shaft and members at either end of the first shaft coupling the same to the second shafts for movement therealong.

3. The die casting machine according to claim 1 including an actuator for selectively moving said gate member to open and closed positions relative to said gooseneck; said gate member having a pair of apertures therein, a first aperture providing communication between said pump chamber and the melting pot when the gate member is moved to its' upper or closed position and a second aperture providing communication between the pump chamber and the gooseneck passageway when the gate member is moved to its lower or open position.

* * * * *